US006615762B1

(12) United States Patent
Scott

(10) Patent No.: US 6,615,762 B1
(45) Date of Patent: Sep. 9, 2003

(54) FOLDABLE BOAT WITH LIGHT WEIGHT HULL CONSTRUCTION SYSTEM

(76) Inventor: William S. Scott, 25200 NW. St. Helens Rd. SB 83, Portland, OR (US) 97231

( * ) Notice: Subject to any disclaimer, the term of this patent is extended or adjusted under 35 U.S.C. 154(b) by 0 days.

(21) Appl. No.: 09/938,129

(22) Filed: Aug. 23, 2001

(51) Int. Cl.[7] ..... B63B 7/00
(52) U.S. Cl. ..... 114/353; 114/354
(58) Field of Search ..... 114/352, 353, 114/354, 357

(56) References Cited

U.S. PATENT DOCUMENTS

| | | | | |
|---|---|---|---|---|
| 381,137 A | | 4/1888 | Hodges | |
| 598,989 A | | 2/1898 | Henery | |
| 833,846 A | | 10/1906 | Perring | |
| 1,920,130 A | | 7/1933 | Pease | |
| 2,053,755 A | | 9/1936 | Wilcox | |
| 2,994,891 A | | 8/1961 | Przybylski | |
| 3,004,370 A | | 10/1961 | Tinnerman | |
| 3,771,180 A | * | 11/1973 | Tanabe | 114/354 |
| 3,869,743 A | | 3/1975 | Brown | |
| 3,916,468 A | * | 11/1975 | Tetreault et al. | 114/352 |
| 3,932,049 A | | 1/1976 | Hirato | |
| 4,110,951 A | | 9/1978 | Padrun | |
| 4,124,910 A | | 11/1978 | Raymond | |
| 4,250,583 A | | 2/1981 | Jensen | |
| 4,274,170 A | * | 6/1981 | Simpson | 114/354 |
| 4,290,157 A | | 9/1981 | Jensen, Jr. | |
| 4,478,167 A | * | 10/1984 | Hart | 114/352 |
| 4,697,540 A | | 10/1987 | Graham | |
| 4,706,597 A | * | 11/1987 | Figone | 114/353 |
| 4,730,573 A | * | 3/1988 | Koon | 114/353 |
| 4,751,889 A | | 6/1988 | Pool | |
| 4,821,666 A | | 4/1989 | Ingram | |
| 4,841,899 A | | 6/1989 | Fleckles | |
| 4,961,397 A | | 10/1990 | Trone | |
| 5,184,436 A | * | 2/1993 | Sadler | 446/478 |
| 5,301,629 A | * | 4/1994 | Kleyh et al. | 114/352 |
| 5,372,085 A | * | 12/1994 | Kaye | 114/354 |
| 5,964,178 A | | 10/1999 | Gonda | |
| 5,975,005 A | | 11/1999 | Yoshioka | |
| 6,006,691 A | * | 12/1999 | Wilce | 114/353 |

* cited by examiner

*Primary Examiner*—S. Joseph Morano
*Assistant Examiner*—Andrew Wright

(57) ABSTRACT

A primary goal of the present invention is to improve the prior art assembly system. The present invention provides a boat of simple ultra light construction with the fewest number of parts that can be easily assembled without tools. Then, when disassembled provides a compact lightweight package suitable for long range or rough terrain portage or back packing. A plastic coated nylon waterproof cover or like skin can be conveniently slid onto, and off of the assembled hull and quickly fastened in place to provide waterproofness for the hull. Another goal of this invention is to introduce a watercraft construction method whose components can be made from extruded corrugated plastic and other plastic materials that are lightweight, but strong, and can be inexpensively mass produced using rule dies and the like inexpensive tooling and assembly methods.

6 Claims, 21 Drawing Sheets

FOLDABLE BOAT WITH LIGHT WEIGHT HULL CONSTRUCTION SYSTEM

FIELD OF THE INVENTION

The present invention relates to a design system for building folding boats, and more particularly to a ultra lightweight collapsible, easily transportable, easy-to assemble Kayak with a structurally secure monocoque, rigid hull and deck system. Eliminating the use of the traditional rib and stringer skeletal frame with outer skin. This is achieved through an improved hull design and construction method and the unique state of the art materials used therein.

BACKGROUND OF THE INVENTION

So called "folding boats", kayaks and canoes have been known for hundreds of years but hitherto have been constructed using the conventional methods of skin over wooden frame or more recently treated canvas or nylon material stretched over an aluminum frame. This creates a very heavy, complicated, craft, which is ill-suited for lightweight back packing, simple quick assembly and small space storage.

DESCRIPTION OF PRIOR ART

Disadvantages of these conventional methods include increased hull drag, which reduces speed and increases expended effort by the paddler. This condition is caused by the lack of inherent support between the hull stringers. (E.G. U.S. Pat. No. 4,821,666 HULL CROSS SECTIONS) which allows the skin to flex inward under water pressure and create pockets and ridges to disrupt the smooth flow of water across the hulls bottom surface. In addition, there is excessive hull flexure inherent in the skin over frame construction that allows the hull to distort its shape as waves pass under it again causing increased drag, paddle effort and friction ware on components. This creates the need for heavier skin materials and more maintenance.

The conventional frame construction methods (E.G. U.S. Pat. No. 4,841,899 WOODEN FRAME AND HARDWARE PIECES), by their inherent design require a high number of wood, plastic, and metal components. (Over 250 in U.S. Pat. No. 4,4841,899). These components increase the complexity, cost, weight and assembly time of this method. Included in the more recent conventional frame and skin folding boats, kayaks and canoes is the use of inflatable sponsors or devices needed to strengthen the hull structure and tighten the skin. These devices also increase total weight, while adding cost in an attempt to create a more ridge hull and eliminate/replace hull flexure. (E.G. U.S. Pat. No. 4,751,889 FIG. 2 ITEMS 60 AND 61) Other drawbacks to following the traditional skin over frame concept with canoes, kayaks, dinghies, and other small boat designs are the shear bulk and weight of these vessels. This often necessitates more than one storage container or bag and the weight of these craft's restrict their use as a true back pack-able boat to be taken along with the necessary camping gear for extended times or distances by a single person. This creates the need to leave important camping gear behind because of the weight or bulk of current folding boat conventional designs. Maintenance is another concern with the conventional skin over wooden and aluminum frames. The user must continually inspect and carefully refinish or otherwise provide a continual protective coating on the wood, aluminum and metal components to prevent delaminating of the wood, corrosion of aluminum and rust of any other metal components.

Performance issues experienced with prior art include excess flexibility in some canoes currently commercially available such as Jensen U.S. Pat. No. 4,290,157. Other folding canoes, which are similar to the Jensen design, have inherent structural weakness that creates problems for users; such as when the paddler sits in the center of the canoe with no weight in each end.

This creates excessive rocker making the hull form into a banana shape. Conversely, if two paddlers sit one in each end of the canoe the hull forms a reverse rocker, looking like an upside-down banana. Both of these conditions create maneuvering and handling problems along with excessive stress on the hull frame structure.

Collapsible, portable, or folding boats disclosed in U.S. Pat. Nos. 3,869,743; 8,338,46; 2,053,755; AND 598,989 represent prior art using extremely complicated hull frames that are complicated and time consuming to assemble. They have a plethora of small loose parts, rib connectors, and ancillary other components that are easy to loose and difficult to use, adding time and frustration to the assembly procedure. The added weight of this prior art make many folding boats unsuitable for pack packing as disclosed in U.S. Pat. Nos. 381,137; 1,920,130; 4,290,157 FIG. 9: U.S. Pat. No. 4,751,889; FIG. 3 thru U.S. Pat. No. 6; 1,920,130; 3,004,370; 4,110,951 and 3,932,049 represent a wide variety of fasteners used for securing tubular components within an assembly. There is a common thread woven through all of these connectors and that is their high cost, complexity and some are not well suited for their use in collapsible portable watercraft frames and are known to fail during use. They also represent higher component and installation costs to the folding boat manufacture and this cost is passed on to the end user. Folding dinghy's disclosed in U.S. Pat. Nos. 4,124,910; 4,697,540; 4,250,583 fold but do not totally disassemble into a small package suitable for transportation in a car trunk or boat cockpit locker and their weight limits their use for back packing.

Collapsible boat U.S. Pat No. 2,994,891 represents the skin and frame prior art and therefore enjoys the same limitations of weight, size, complexity, high manufacturing costs, small space storage, transportation and back packing capability.

Foldable boat U.S. Pat. No. 5,975,005 this prior art uses rigid hull forming sections with a separately attached hinging system to facilitate folding of the hull forming sections. A special molded, interlocking engagement projection configuration is used to join the hull forming sections together in an effort to add lateral strength to the assembly and capture the ends of the hull forming sections into a unit. The materials listed (I.E. Aluminum titanium, rigid wood, fiber-reinforced plastic, epoxy, polyester, polyethylene, resins reinforced with glass fiber, carbon fiber or the like) are all materials requiring special machining, molding processes and tooling, which are all specialized, expensive materials and manufacturing processes. The flexible members, and tightening piece and hooks used to assemble the foldable boat and hold it together present some risk to the boat operator if one of the top, side flexible members loosen or lets go. This would potentially allow the water pressure to push in the side allowing water to enter the boat in large quantities over the topside of the hull forming side member. Other limitations of this prior art are the box shape and potential for use of more streamlined hull shapes used in dinghies, kayaks and canoes. High flotation loss due to the volume and weight of the hull forming members and assembly flexible members and hardware, will reduce the total load carrying capacity.

In summary, this prior art employs a design and materials that limit its application to basically box type boat shapes that are heavy, have little aesthetic appeal and would not be suitable for use in canoe, kayak, dinghy, or other folding watercraft, used in backpacking or light weight folding water craft, used in backpacking or light weight folding boats construction and manufacturing.

SUMMARY OF THE INVENTION

It is the object of this present invention to overcome the disadvantages of the prior art and provide a collapsible kayak, canoe or folding boat that is super light weight with a rigid hull having a minimum of components that will provide performance more typical of non-folding rigid hull watercraft.

It is also the specific goal of this present invention to provide here-to-fore unattainable hull rigidity with the inherent lightweight and simplicity of construction and assembly needed in higher performance lower cost portable watercraft. It is also the specific goal of this present invention to eliminate the use of the traditional skeletal frame with all its separate support members, clamps and special complex fasteners through the novel use of extruded corrugated high density plastic sheet coupled with a unique simple method of constructing semi-rigid hull and deck sections for folding, portable, light weight watercraft.

It is also a specific object of this invention in connection with the construction of a folding boat, canoe, dinghy or kayak, to provide by incorporation of extruded corrugated plastic, enhanced resistance to hull and skin flexure with improved through the water performance more like a rigid hull shell than a folding boat.

It is also a specific object of this invention to reduce flotation loss and increase load carrying capacity through the unique use of light weight extruded corrugated, high-density plastic sheet and elimination of the skeletal frame and its components reducing the total weight of the watercraft thus increasing the load carrying capacity of the watercraft.

It is further the specific object of this invention to eliminate the unsupported hull skin areas allowing for a lighter waterproof skin with fewer reinforcements, lighter weight and elimination of the need for air-bladder skin tightening and hull strengthing systems.

BRIEF DESCRIPTION OF THE DRAWINGS

FIG. 1 is top view of the kayak hull with seat.

| | |
|---|---|
| 1 | #1 Rib Cap Assembly |
| 2 | #2 Rib Cap Assembly |
| 3 | #3 Rib Cap Assembly |
| 4 | #4 Rib Cap Assembly |
| 5 | #5 Rib Cap Assembly |
| 6 | #6 Rib Cap Assembly |
| 7 | #7 Rib Cap Assembly |
| 8 | #1 Hull Section |
| 9 | #2 Hull Section |
| 10 | #3 Hull Section |
| 11 | #4 Hull Section |
| 12 | #5 Hull Section |
| 13 | #6 Hull Section |
| 14 | #7 Hull Section |
| 15 | #8 Hull Section |
| 16 | #1 Deck Section |
| 17 | #2 Deck Section |
| 18 | #3 Deck Section |
| 19 | Port Deck Section |
| 20 | Starboard Deck Section |
| 21 | #6 Deck Section |
| 22 | #7 Deck Section |
| 23 | #8 Deck Section |
| 24 | Floor Boards |
| 25 | Water Proof Cover |
| 26 | Entire Boat |
| 27 | Bow (Forward) |
| 28 | Stern (Aft) |
| 29 | Seat and Back Rest |
| 30 | Arrow - Direction of movement |
| 31 | Port Side |
| 32 | Starboard Side |
| 33 | Shock Cord Drawn String |
| 34 | Slide Cam Lock |
| 35 | Rib Flaps |
| 36 | Bi-Fold, Accordion Section |
| 37 | Cinch Strap |
| 38 | Web Belt Anchor |
| 39 | "D" Ring |
| 40 | Hook and Loop Fastener |
| 41 | Rib Cap Fastener Holes |
| 42 | Nylon Thumbscrew |
| 43 | Nylon Wing Nut |
| 44 | Extruded Plastic Channel |
| 45 | Gasket Seal |
| 46 | Cockpit |
| 47 | Hull Assembly |
| 48 | Deck Assembly |

-continued

| | |
|---|---|
| 49 | Flap Fastener Holes |
| 50 | Hinge Score Line |
| 51 | Boat Bottom |
| 52 | Deck Attachment Flaps |
| 53 | Rib Cap Front Side |
| 54 | Rib Cap Rear Side |
| 55 | Rib Cap Cross Member |
| 56 | Parallel Surface Sheets |
| 57 | Vertical Ribs |

DETAILED DESCRIPTION OF THE DRAWINGS

Referring in detail to the drawings, and particularly FIGS. 1, 2, 3 and 4, the FOLDING KAYAK of the invention is indicated in its entirety at 26. In various ones of the figures, an arrow applied, for convenience, to indicate direction of movement, and thus orientation of the kayak. The kayak includes a bow 27, a stem 28, a starboard side 32, and a port side 31. It has a cockpit or 46 to accommodate passengers.

Figure 3:
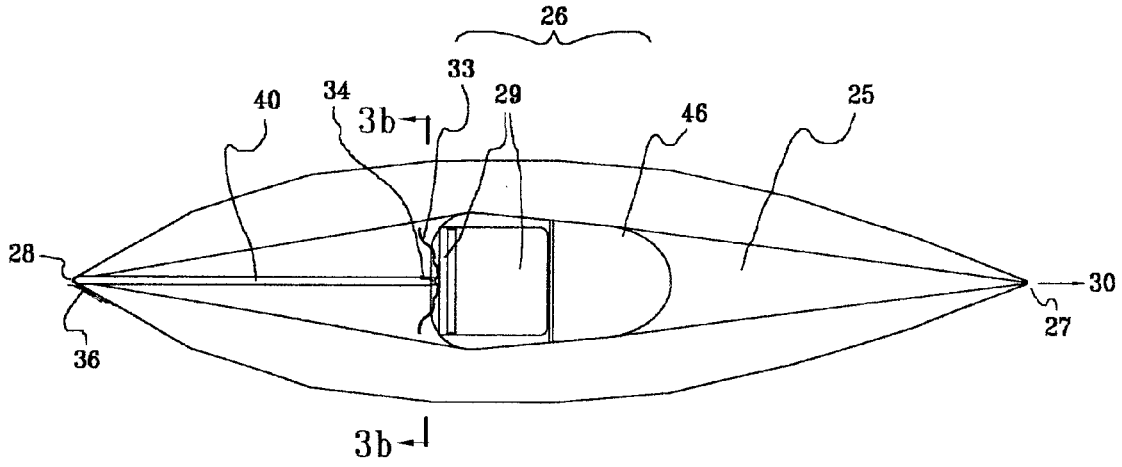
FIG. 3 is a top view of the hull with the waterproof cover installed.

The FOLDING KAYAK includes a hull 47; a deck assembly 48, and a waterproof cover FIG. 3,25. The present invention, folding kayak, is composed of twenty-three primary components, namely hull sections, eight deck sections and seven rib caps. As will be seen in FIG. 6 the eight-section hull is generally referenced 47, and the eight deck sections 48 with the rib caps indicated #1 through#7.

Figure 1:
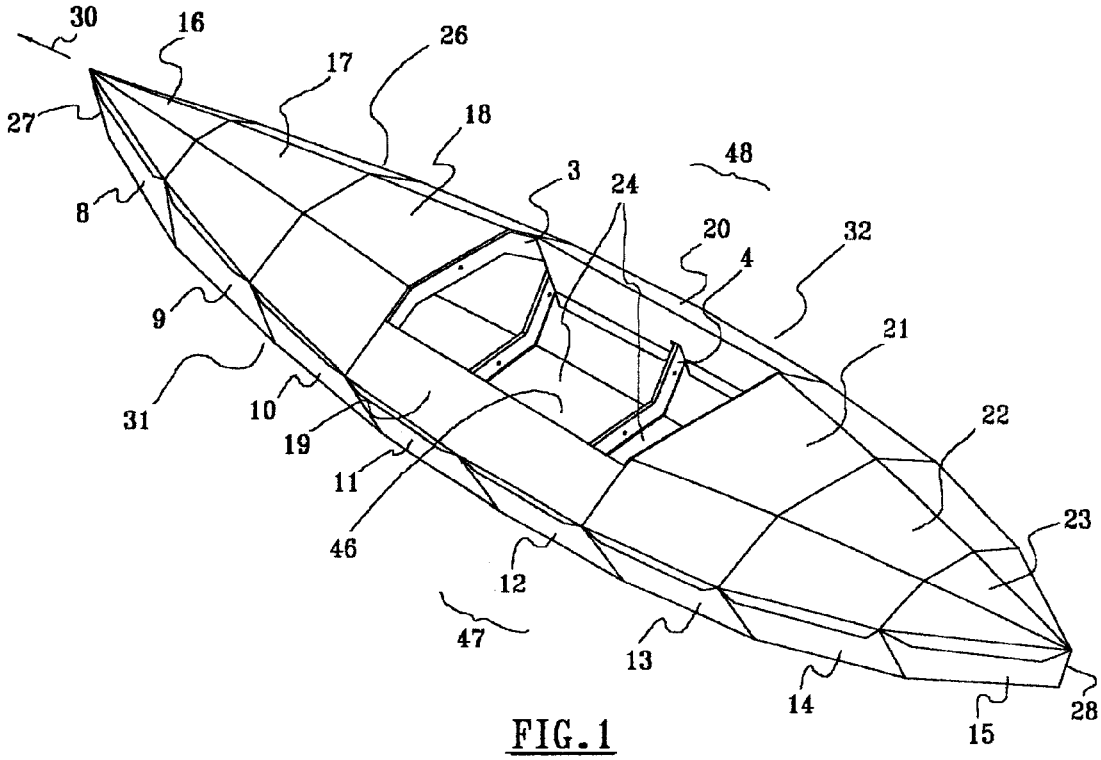
FIG. 1 is a perspective view of the monocoque kayak hull without the waterproof cover taken from the rear and above.
Figure 5:
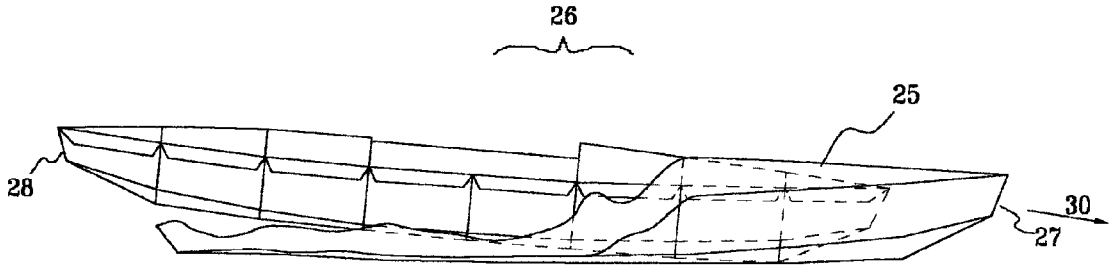
FIG. 5 is a view similar to FIG. 4, but showing the bow section of the hull aligned and inserting into the waterproof cover.
Figure 6:
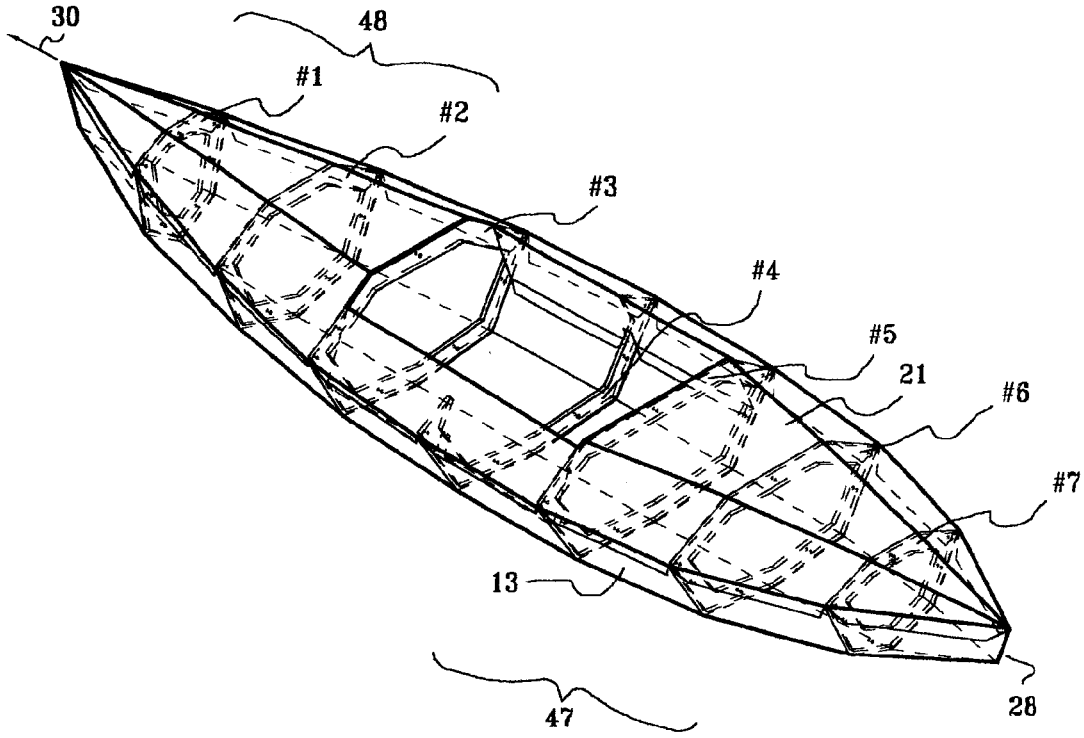
FIG. 6 is a perspective view looking through the hull (hidden view) at the rib cap, hull and deck assembly ten from the port side rear and above.

A basic embodiment of the present invention built according, to the structure, materials and methodology, described herein, is a kayak as shown in perspective views in FIG. 1 and 6. It comprises a system of three major sub-systems: a waterproof cover system FIG. 5, 26; a monocoque hull FIG. 1,47 a deck assembly 48, and a rib cap, hull and deck fastening system FIG. 6, #1 through #7 with fasteners FIGS. 42 and 43. FIGS. 3, 3*a*, 3*b*, 7, 8, 10, and 12 show details of the three sub-systems.

1. Monocoque hull and deck

Figure 2:
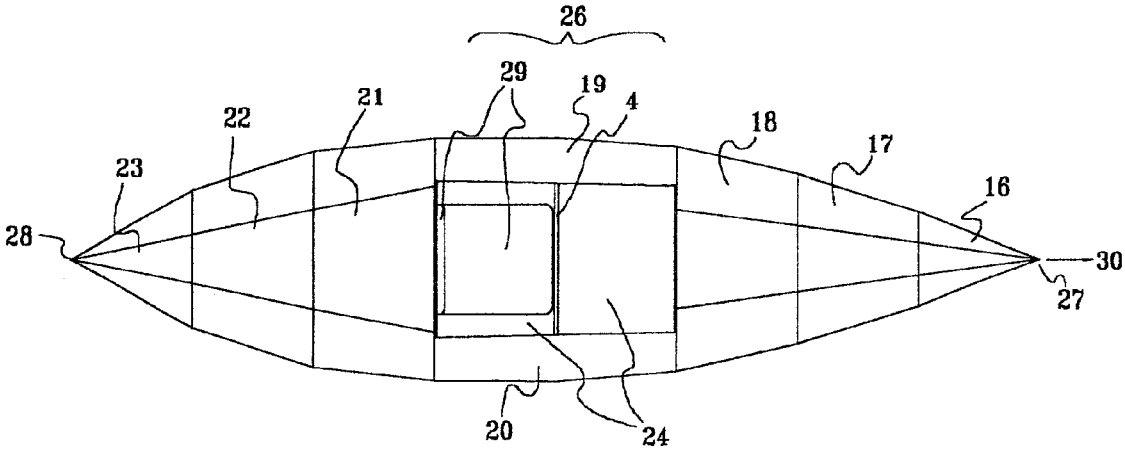
Figure 3B:
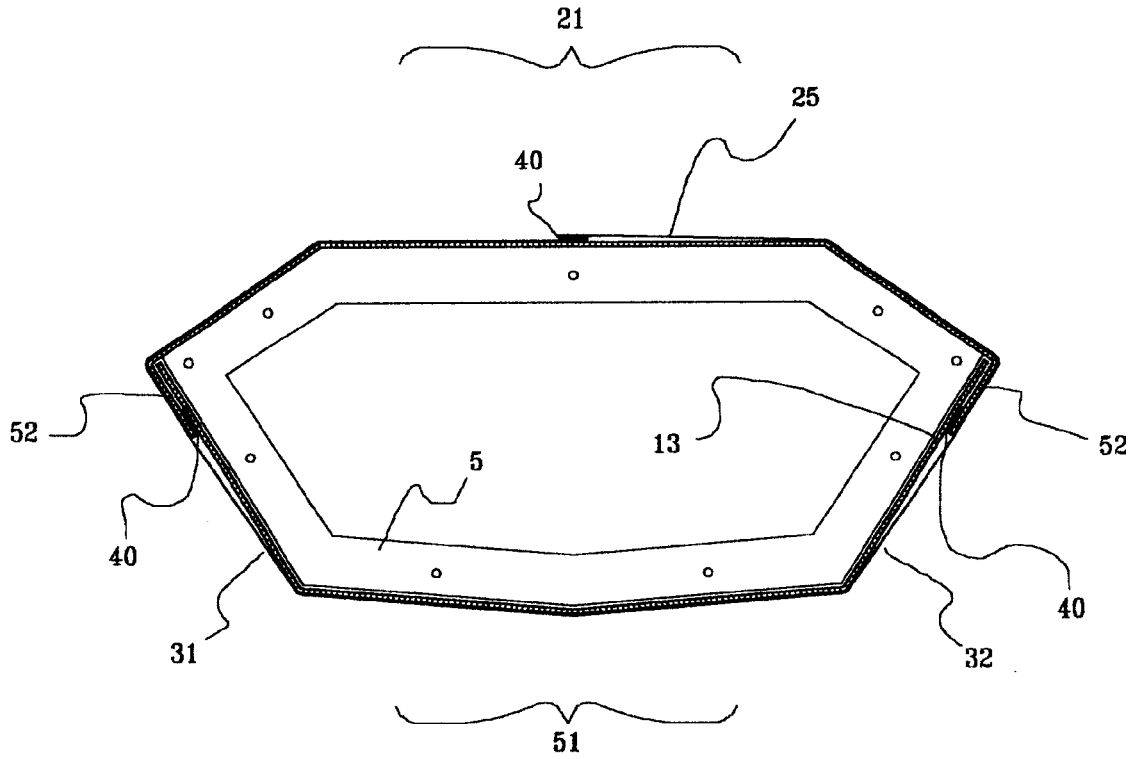
Figure 4:
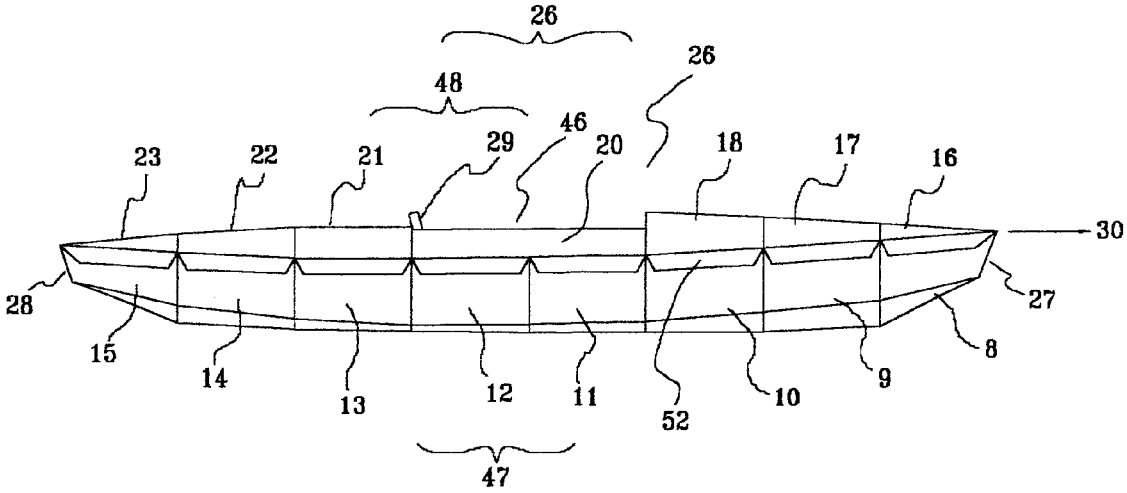
FIG. 4 is a side elevation view of the kayak of the invention, from the starboard side.
Figure 7:
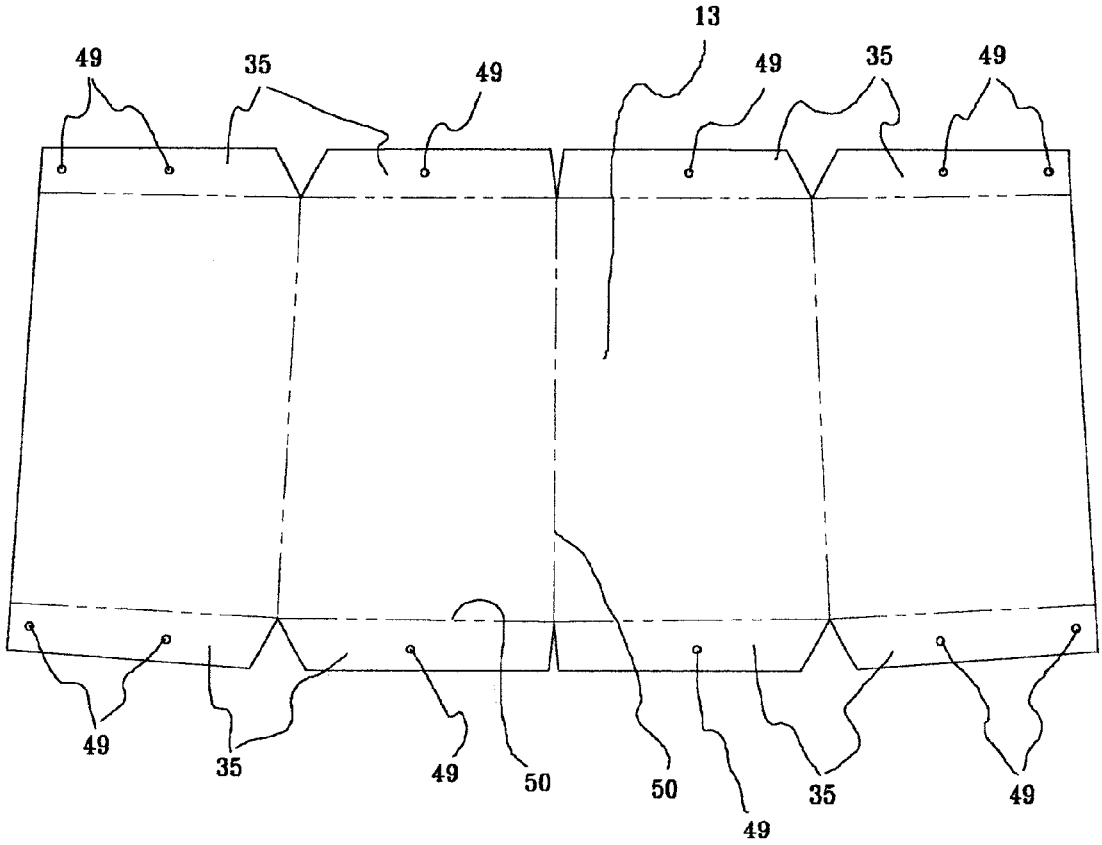
FIG. 7 is a top view of a typical hull section in the flat pattern unfolded state.
Figure 8:
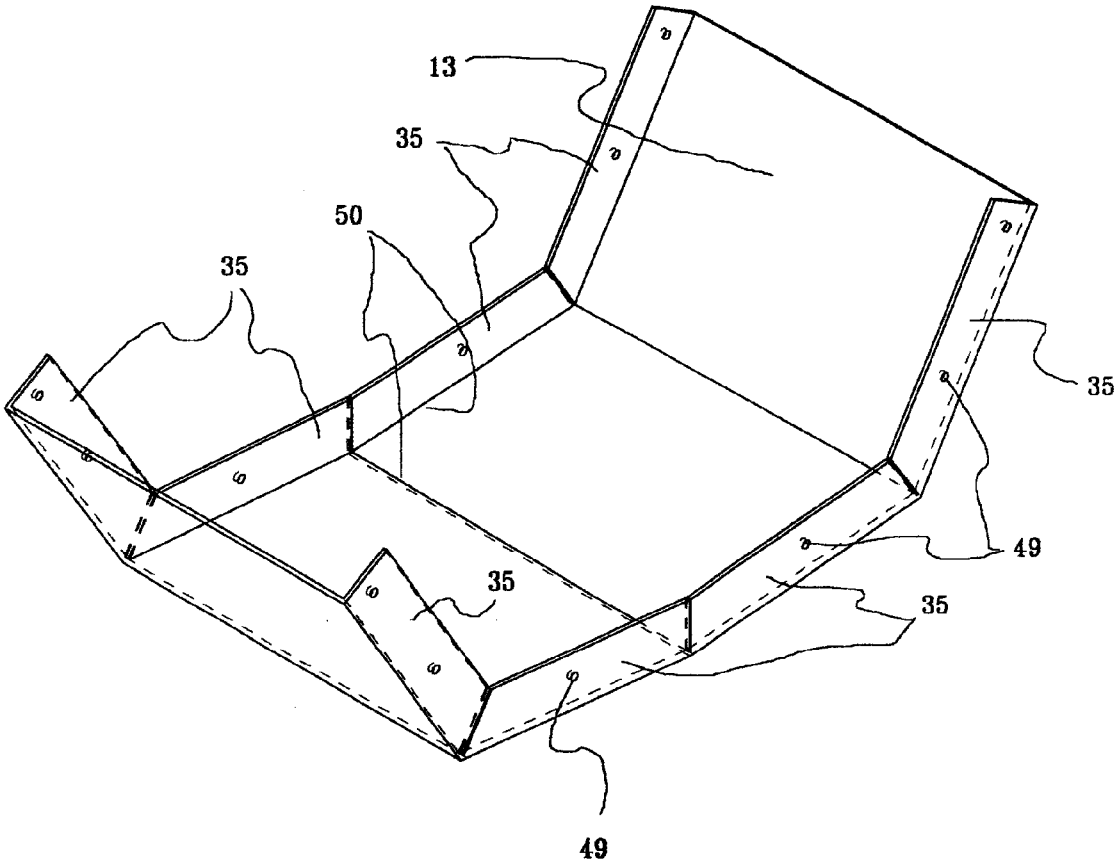
FIG. 8 is a perspective view of the hull section in FIG. 7 in the folded state ready for assembly with the rib cap and next hull section.
Figure 9:
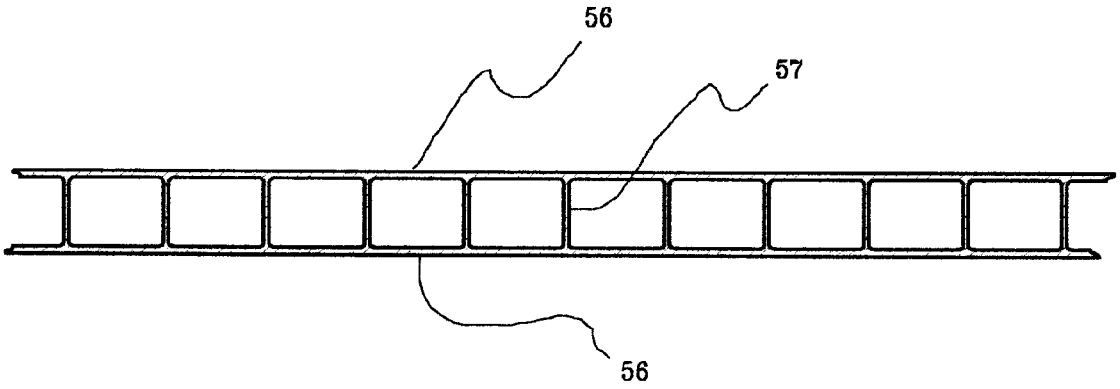
FIG. 9 is a cross sectional end view showing the configuration of the extruded hull and deck corrugate plastic material.

The hull 47 and deck 48 seen in FIGS. 1, 2, 4 and 6 are constructed form extruded corrugated copolymer polypropylene and polyethylene high impact and high density plastic sheet FIG. 9 consisting of two flat sheets 56 connected by vertical ribs 57. The hull sections being individually identified 8 through 15 include separate sections detachably and releasable secured together. Each hull section FIGS. 1 and 4, 8 through 15 are cut out in a flat pattern FIG. 7 having an outside peripheral shape with fasteners holes 49, rib flaps 35 and hinge score lines 50. The flat blank hull section FIG. 7 of hull section 13 is then folded up into the hull assembly shape FIG. 8 by folding the flat blank FIG. 7 at the hinge score line 50 forming the "Living Hinge" and hull section 13, by creating the ribs 35 boat bottom FIG. 3*b*, 51 along with port 31 and starboard 32 sides. This same process is repeated for all hull sections in FIGS. 1 and 4, 8 through 15. The deck sections seen in FIGS. 1, 2 and 4 are individually identified 16 through 23. These are constructed from extruded corrugated copolymer polypropylene and polyethylene high impact and high-density plastic sheets, FIG. 9, and consist of two flat parallel surfaces 56 connected by vertical ribs 57. The deck sections 16 through 23 include separate sections detachably and releasable secured together. Each deck section FIGS. 1, 2 and 4, 16 through 23 are cut out in a flat pattern having an outside peripheral shape with rib flaps 35 and deck attachment flaps 52, FIG. 3*b* and hinge score lines so the flat blank deck section is folded up at the hinge score lines 50 forming the "living Hinge" and the cross sectional shape FIG. 3*b*, hull section 21 along with the rib flaps which are the same as shown in FIG. 7, 35 and deck attachment flaps 52 for port 31 and starboard 32 sides FIG. 3*b*. This same process is repeated for all deck sections FIGS. 1, 2, and 4, 16 through 23.

2. Rib Cap Fastening system

Figure 10:
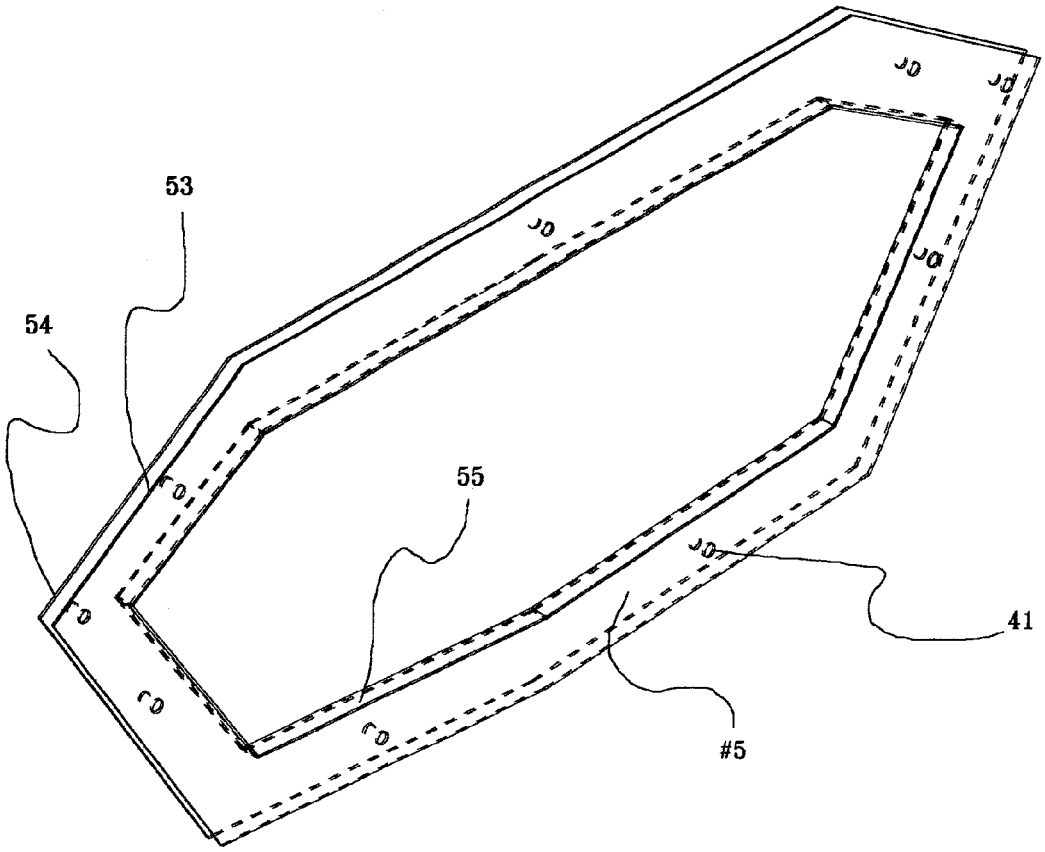
FIG. 10 is a hidden line perspective view showing the construction details of a typical rib cap.
Figure 11:
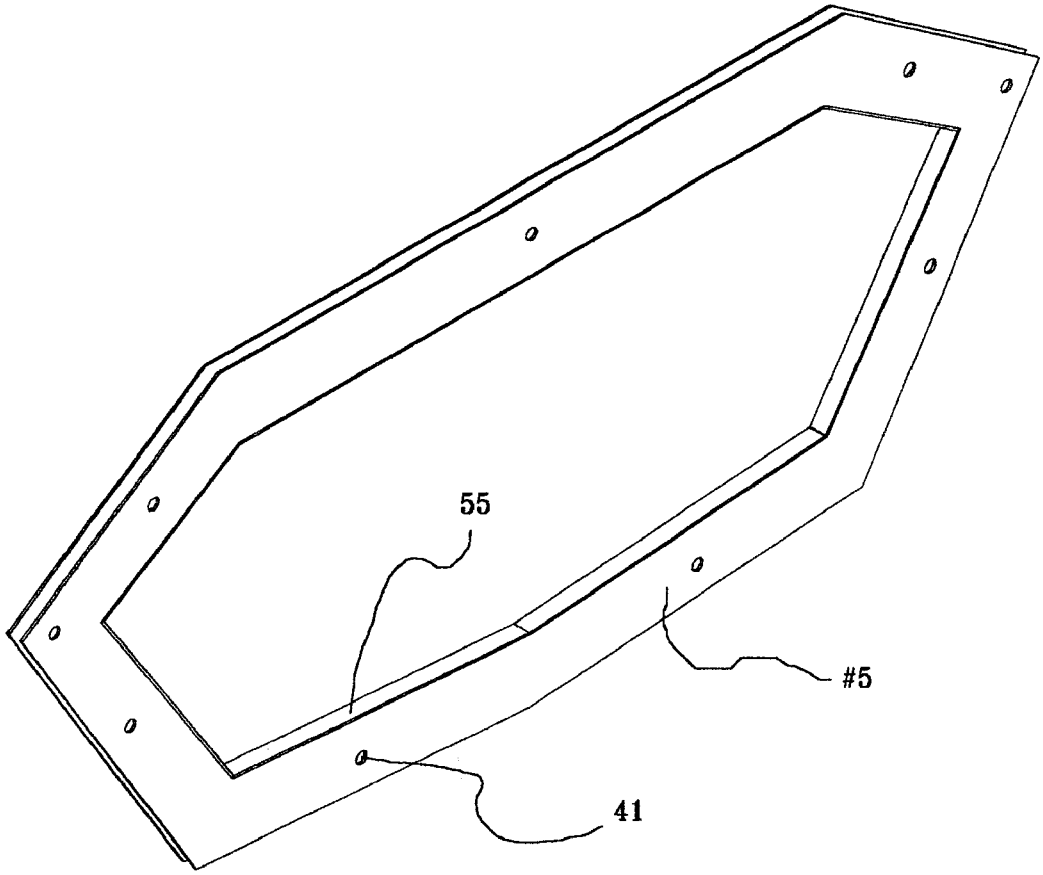
FIG. 11 is a perspective view of a typical rib cap.
Figure 12:
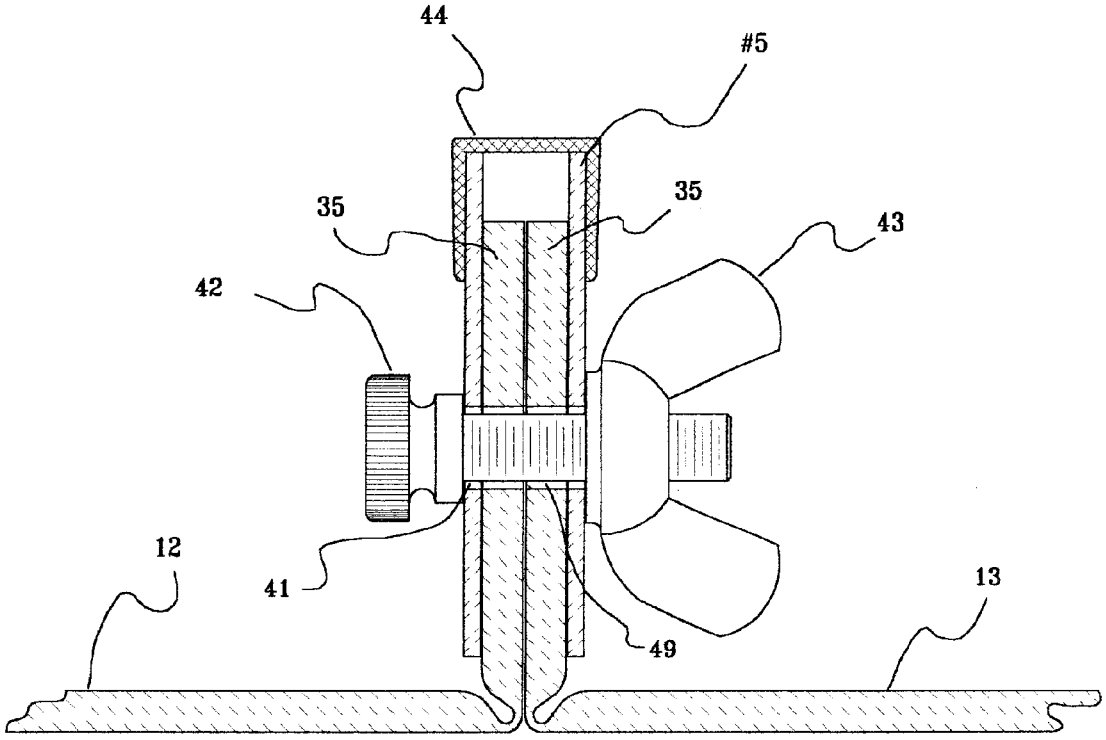
FIG. 12 is a cross section view through a typical fabricated rib cap assembly showing the assembly of two hull sections.
Figure 13:
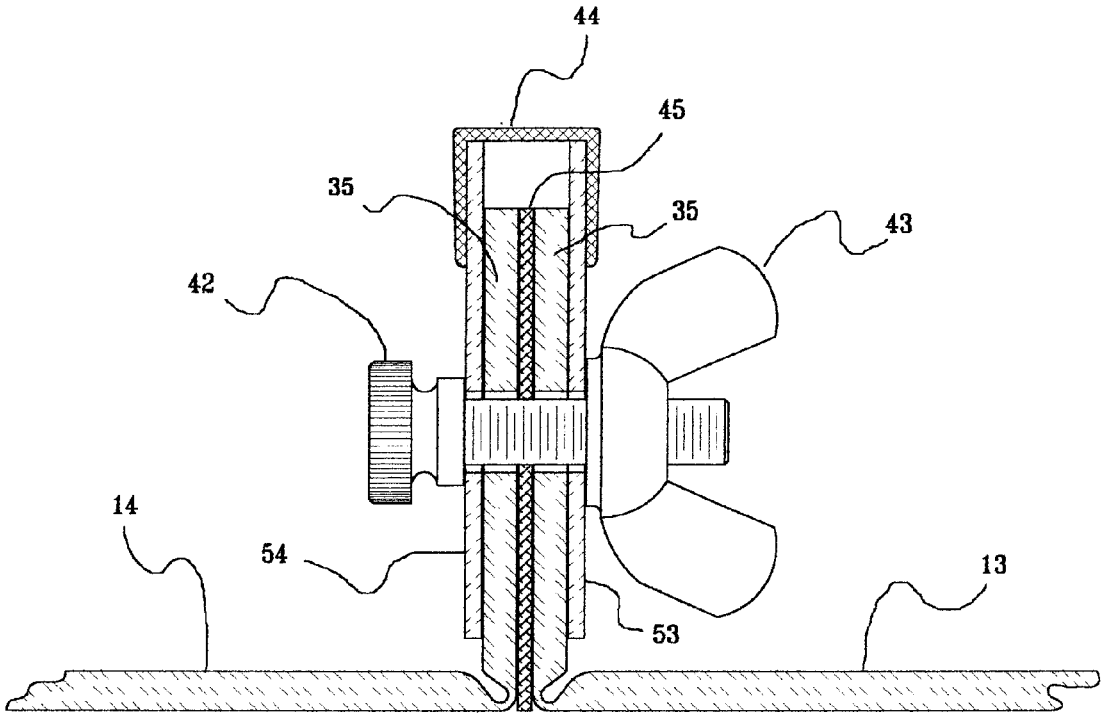
FIG. 13 is a cross section view through a typical fabricated rib cap assembly having a rubber gasket set to eliminate the need for a waterproof cover.

Looking at FIGS. 6, 10 and 11 you see the rib caps individually identified as #1 through #7. The rib caps for this present art kayak are constructed from suitable plastic material such as ABS that can be either laser, rule die cut, or other manufacturing methods discussed herein. FIG. 10 shows the rib cap #5 assembly that supports the hull 47 and deck 48 at hull section 13 and deck section 21 respectively as shown in FIG. 6. The two FIG. 10 53 and 54 front and back rib cap sections are joined together with a gluing process by cross members 55. FIG. 11 shows the clean lines and simplicity of the finished rib cap #5 assembly an alternate construction method is shown in FIGS. 12 and 13 where by an extruded plastic channel 44 is cut to length and glued around the inside opening of the rib cap. Front 53 and rear 54 rib cap laser cut side sections shown in FIG. 10 completing the simple strong light weight assembly as seen in FIGS. 11 and 12. The hull 47 and deck 48 sections, having been folded into their respective shapes FIGS. 8 and 3*b*, are then aligned with each other so that the folded up rib flaps 35 as shown in FIGS. 12 and 13 are butted up against each other. The rib caps FIG. 6 #1 through #7 are then slipped over each set of folded up rib sections and aligned with the fastener holes FIG. 7,49. The nylon thumbscrew FIG. 12, 42, is slipped through the rib cap #5 and hull section 12 and 13 assembly. The wing nut 43 is now treaded onto the thumbscrew 42 and tightened. This process is repeated at each of the seven rib cap stations FIG. 6 #1 through #7. The deck sections FIG. 1,16 through 23 are now aligned over each respective hull section FIG. 1, 8 through 15. The folded down rib flaps 35, FIG. 8 are aligned and slipped down into the rib cap top section until it touches the tops of the rib caps as shown in cross section in FIG. 3*b*.

Now the deck attachment flaps FIG. 3*b*, 52 having hook and loop fasteners 40 are pressed down against the corresponding port 31 and starboard 32 hull sides also having hook and loop fasteners to complete the assembly. Referring to FIG. 13, another alterative method to creating a waterproof hull without using a waterproof cover is to add a gasket seal 45 in between the fold up rib surfaces 35 to create a waterproof seal and eliminate the use of the waterproof cover 25, FIG. 3, thus reducing the kayak weight by approximately three additional pounds and reducing the total back pack folded down weight to around thirteen pounds.

3. Waterproof Cover System

Figure 3A:
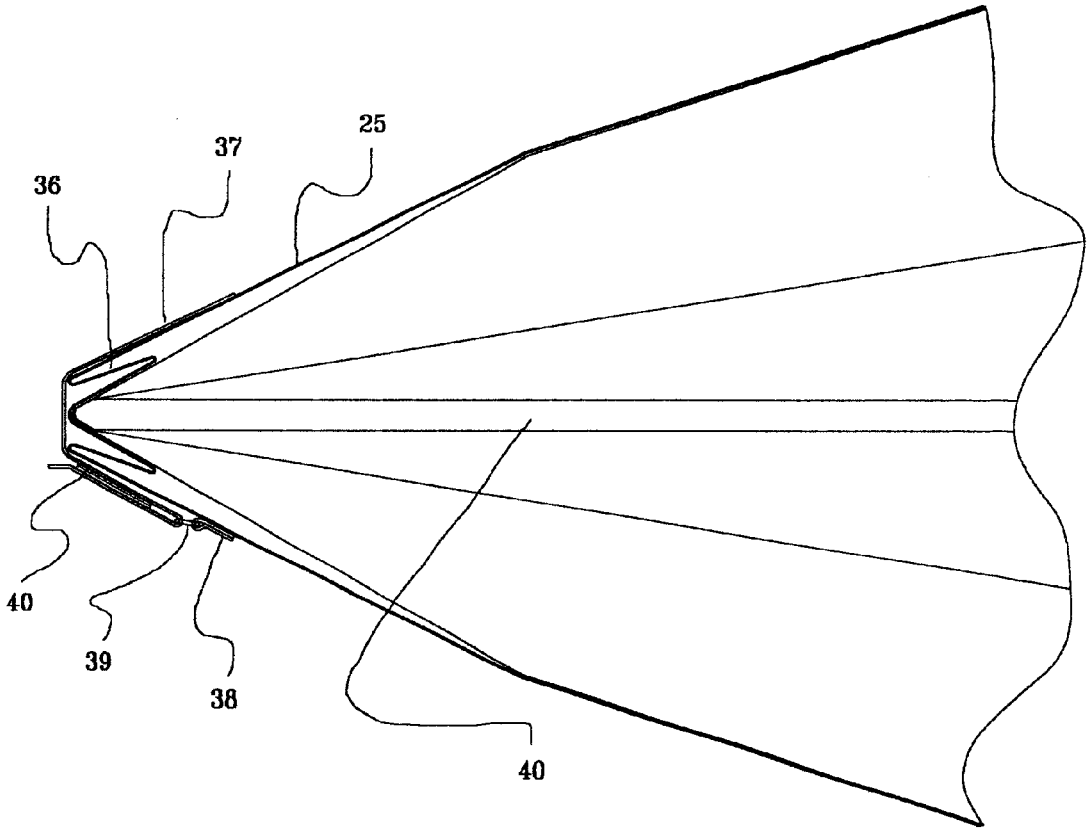

Referring to FIGS. 3, 3*a* and 3*b* shows the embodiment of the waterproof cover for the present art lightweight folding kayak FIG. 1,26. The waterproof cover FIG. 3,25 comprises a plurality of panels cut to a specific shape from suitably strong and flexible material having a waterproof coating and commonly used for kayaks, canoes and inflatable boats. These panels are sewn together and may be heat-sealed or seam-sealed using a coating in a separate operation on the sewn seams as with tent seam-sealing using a seam-sealing liquid applied to the sewn seams to prevent leakage. The folding kayak waterproof cover 25 utilizes a single split entry section down the center of the aft deck section 28. This split section uses hook and loop fastening FIGS. 3,3*a* and 3*b*, 33 to maintain light weight and facilitate closure of the aft deck cover and create a snug fitting relation of the cover to the hull 47 and deck 48 assemblies FIGS. 1 and 6. At the aft end 28 of the waterproof cover 25 is a unique Bi-fold cover tightening system FIG. 3*a*, consisting of an accordion shaped extended hull cover section 36 that is adjusted and held in place by the cinch strap 37 which is looped through a "D" ring 39 fastened to the waterproof cover by web belt anchor 38. The waterproof cover tension can be adjusted to compensate for stretch or shrinkage by adding to or releasing the tension on the cinch strap 37 and then pressing the cinch strap 37 back against itself to engage the hook and loop fastener system 40 to maintain the adjustment position of cinch strap 37. The cockpit or hatch FIGS. 1,3, and 4,46 shape and adjustment is accomplished by tightening the shock cord drawstring and maintaining the adjusted position of the drawstring with the slide lock 34.

4. Versatility of the Invention by Ease of Assembly

The versatility of the present invention is illustrated, in part, by appreciating the following detailed description of how one can assemble the folding kayak of the present invention. Lay the compact carrying bag on the ground and remove the stuff bag labeled "Hull sections,". Remove hull bow 27, section 8, FIG. 1 and fold into its designed shape. Remove hull section 9 and fold it into its designed space and place next to the bow section on the ground so that the rib flaps 35, FIG. 8 are adjacent to each other. Remove rib cap #1, FIG.6 from the stuff bag labeled "rib caps," and slip over hull sections 8 and 9 rib flaps 35. Align rib flap fastener holes 49, FIG. 8 with the rib cap fastener holes 41, FIGS. 10,11, and 12. Slide the nylon thumbscrew fastener 42, FIG. 12 through the rib assembly until the nylon thumbscrew 42 is flush against the rib cap surface 54, FIG. 13. Now, thread the wing nut fastener 43, FIGS. 12 and 13 onto the nylon thumbscrew fastener 42 until snug. Align and install the remaining nylon thumbscrews 42 and wing nut fasteners 43 into the #1 rib cap assembly. The same procedure is used six more time to assemble the remaining rib caps #2 through #7, FIG. 6 with the hull sections 10 through 15, FIG. 1. You now have the completed hull assembly 47 FIG. 1 sitting on the ground in front of you ready for the deck assembly 48, FIG. 1. Remove the stuff bag labeled "deck sections" from the carrying bag, open it and remove deck section 16, FIG. 1 and fold it into its designed shape with the deck attachment flaps 52, FIG. 3*b* pointing down at the ground. Align deck section 16, FIG. 1 over hull section 8, FIG. 1 and slip rib flaps 35 down into rib cap #1, FIG. 6, top section until it touches the top of the rib cap as shown in the cross section in FIG. 3*b*. Fold down and in the deck attachment flaps 52, FIG. 3*b* having hook and loop fasteners 40 and press in against the hull section 8, FIG. 1 port 31 and starboard 32 sides also having hook and loop fasteners to lock the hull section 8, deck section 16 and rib cap assembly into one ridged unit. In succession remove the remaining deck sections 17 through 23 from the stuff bag and follow the same procedure until all hull 47 and deck 48 components are assembled as a unit into a rigid monocoque kayak assembly ready for the waterproof cover.

Remove the waterproof cover 25 from the carrying bag and open the aft single split entry by separating the hook and loop fasteners 40, FIGS. 3 and 3*b* and loosen the shock cord drawstring 33, FIG. 3 then place the cover on the ground, unrolled with the open side up. Lift the assembled kayak 26 and align it above the waterproof cover so that the bow 27 of the assembled kayak and waterproof cover are both pointing in the same direction of arrow 30. Now slip the bow 27 of the kayak into the bow section 27 of the waterproof cover 25, FIG. 5 and align the cover while pulling it onto the front section of the kayak until the cover is pulled tight with the bow end 27 and you can see a tight fit with the foreword deck and hull sections. Slip the aft 28 single split entry section of the waterproof cover up over the aft 28 end of the kayak and adjust so that the entry edges will align with the centerline of the kayak when you refasten the hook and loop single entry fastener 40, FIGS. 3 and 3*b*. Adjust the waterproof cover tension by tightening the cinch strap 37 over the bi-fold flaps and secure in place by pressing the hook and loop fasteners 40, FIG. 3*a* together to complete the assembly. Tighten the waterproof cover around the cockpit 46, FIG. 1 by adjusting the tension of the shock cord drawstring 33, FIG.3 and locking it in place using the slide cam lock 34. Complete assembly of the kayak by placing the floor boards 24, FIG. 1 in the bottom 51, FIG. 3*b* of the inside of the cockpit 46, FIG. 1 these are held in place by the rib caps #3, #4 and #5, FIG. 6. Place the seat and backrest 29, FIGS. 2 and 3 into position so they engage the hook and loop fasteners that hold them in place. Put on your personal flotation device (PFD) pick up a paddle, launch the kayak into the water, get in, paddle and go have fun!

From all of the above the reader will see that the present invention is a versatile structure and methodology for building lightweight, easy to transport, easy to assemble folding watercraft. While the description of the basic embodiment of the invention, a kayak, is described in detail, it is only one embodiment among many possible ones. It should not be construed as a limitation on the scope of the invention but as an exemplification of one preferred embodiment thereof Other exemplary embodiments are illustrated in FIGS. 14, 15, 16, 17, 18 and 19 and discussed herein.

The present invention describes material, structure and methodology to build a variety of rigid-hulled lightweight folding boats such as kayaks, dinghies, row boats, open canoes, yacht tenders, prams, kick and pontoon boats. Such craft, and many others, are included within the scope of this invention. The present invention is a totally new state-of-the-art concept, which has produced several individual improvements new to the building of foldable watercraft. These improvements actually generate a design and construction system that when this technology is applied to a boat it places it into the category of a new lightweight generation of folding boats. The basic embodiment discussed herein is a kayak. The shape of the present embodiment of this invention is representative of many modem kayaks being constructed today and can best illustrate the application of this new construction system. However, many other very different embodiments are described in the section on representative alternate embodiments to illustrate the broad range of the potential applications of this system. These alternative embodiments include additional kayak designs and other types of watercraft. The advancements and improvements of the present invention over prior art in the present embodiment of a folding kayak are as follows.

1. Materials use as Key to the Present Art Construction System

The material of an ultra light weight hull must minimize weight without sacrificing strength or economy of manufacture, this material must also possess the ability to be shaped into hull and deck forming sections with the integral ability to flex or hinge at section forming joints thus eliminating the frame and stringers of conventional folding boats that provide reinforcement through these frame assembly's. To that end, state-of-the-art copolymer, polypropylene and polyethylene high-impact and high-density plastic, in extruded thin wall corrugated sheets has been tested and selected as the material able to meet this present art design and performance requirements. This material is referred to by brand names such as: Hi~CORE®, COROPLAST™, COREX, PLASTICORE®, BIPLEX and others. Corrugated thin wall plastic is a one-piece process extruded sheet consisting of two flat sheets connected by vertical ribs. This material is super-rugged and extremely lightweight.

Unaffected by water, it will not rust, corrode, rot or mildew; it is virtually tear-proof, withstands wide temperature variances, resists puncturing, high impact damage and is designed for harsh outdoor weather conditions. This material is chemically inert with a nil pH factor making it environmentally sound. It is waterproof, floats, stain-resistant, can be flexed an unlimited number of times without breaking. This unique ability is called "A Living Hinge". All of the elements and benefits hither to discussed about the corrugated, light weight, thin wall, plastic material are key factors, or the heart of the present art, and is responsible for making this unique ultra light, no skeletal frame, rigid hull, folding boat construction system possible.

2. Low Cost Hull and Deck Manufacturing Methods

The choice of extruded corrugated plastic for the present art and other watercraft types and designs included in this patent. Is based, as well, on its ability to be easily precision CNC laser or die cut. The manufacturing method intended for use herein the present art is a "RULE DIE". The "RULE DIE", on a flat bed press will produce extremely accurate CAD designed boat hull and deck sections with all critical bend creases in one press stroke. The present art uses three four by eight extruded plastic sheets. Therefore, for every three strokes of the press there is one complete present art light weight folding kayak produced, satisfying the present art goal of introducing lightweight folding kayaks and other water craft included in this patent at an extremely low manufacturing cost, because of the high reduction in manual labor normally associated with prior art conventional skin on skeletal frame construction. In addition to the low manufacturing costs the extruded plastic sheet cost in volume in higher quantities are under ten dollars at present. Therefore making it possible for the present folding kayak and the other watercraft included in this patent to be sold for a much lower price than the conventional folding watercraft prior art. Making possible the enjoyment of the paddling water sport available to many more people who cannot afford the thousand plus dollars needed to purchase most of the modem day folding kayaks, canoes and other watercraft available today.

3. Rigid Monocoque Hull and Deck with Integral Hinges ("The Living Hinge")

The unique ability of extruded corrugated plastic to have the stiffness of thin plywood yet having the quality to be creased and bent to form "the living hinge" facilitates the construction of the hull and deck section in what is termed the "flat Bank". These "Flat Blanks" having the outside perimeter precisely cut to the correct size and the bend lines precisely embossed in the correct location, so that when the "FLAT BLANK" is folded up into its hull section shape, creating the integral ribs by use of the "living Hinge". These folded up hull sections are then joined together with the plastic rib caps and nylon fasteners. The deck sections, having been precisely cut to the correct outside perimeter with the precision located embossed bend lines, are folded up into their proper deck section shape and located over the corresponding hull section. The integral deck stiffeners and fastening flaps are located inside of the rib caps and outside of the hull gunwale respectively. The fastening flaps are folded down and pressed against the gunwale to engage the corresponding Velcro (a brand name) hook and loop fastener strips affixed to the outside hull gunwale and the inside of the deck section fastening flaps to join the hull and deck sections into a non-flexing, rigid, monocoque kayak hull and deck assembly.

4. Rib Cap System

The hull sections, having been folded into their respective hull shape, are then aligned with each other and the rib caps are placed over the integral ribs to encapsulate them within their "U" shape. Nylon thumbscrews are then passed through corresponding holes in the rib caps and the integral hull section ribs then tightened with a wing nut to clamp the hull sections together. The rib clamps also clamp the deck sections by their deck stiffeners creating a monocoque assembly. In addition to the clamping function the rib caps add radial and axial strength to the hull and deck sections preventing flexure and movement of the folding kayak assembly. Construction of the rib caps is accomplished for the present art with CNC laser cut ABS plastic components fastened together in a fixture. However, construction is not limited to this method as glass fiber cloth and epoxy clamped in a mold has produced these rib caps as well. Other processes such as plastic injection molding, rotational-molding, rule die cutting, and many other methods are capable of producing these components. The choice is driven by component weight, volume, quality and economics.

5. Waterproof Cover

The function of the waterproof cover with the present invention is not to create the hull shape, outer boat skin or add strength to the hull as it is normally employed in prior art. On the contrary, the primary function of the waterproof cover is to seal out water from entering between the rigid hull and deck sections and to add esthetic value to the folding watercraft. It is desirable to have a waterproof cover for a folding kayak or water craft which is very light in weight, waterproof and strong, yet is simple and inexpensive to manufacture. It is a high priority to minimize the weight of all materials in the covers construction since this will enhance the portability of the kayak or watercraft. The simplicity of design for the present art cover makes repair under wilderness conditions very simple and easy with minimum tools and materials. The present art cover utilizes a single split entry section down the center of the aft deck section. This split entry section uses Velcro (a brand name) hook and loop fastening to maintain light weight and facilitate closure of the aft deck cover and create a snug fitting relation of the cover to the hull and deck assembly. At the aft end of the waterproof cover is a unique cover tightening system with Bi-fold flaps and tightening strap to apply a linear pull along the kayaks centerline axis. Thus allowing for loosening and tightening of the cover during wet, dry, hot or cold conditions causing material shrinkage or stretch. This bi-fold flap system coupled with the aft deck cover opening, enhances the ease in which the assembled boat hull is slid into the cover and the aft deck cover is closed and sealed with the hook and loop fastener. The material for the cover chosen after extensive research and testing are Cordura (a brand name by Du Pont) a high density nylon cloth with a urethane water barrier used by the military for many tough applications including boot uppers. Cordura nylon cloth is known as the standard for toughness; abrasion and scuff resistance puncture and tear resistance in hard use and extreme out door conditions. Abrasions resistance is the greatest concern for the durability and long-term life of this present arts waterproof cover and tests have shown that Cordura will last three times longer than standard nylon cloth. The second material selected for the areas above the water line, including the deck, is a 3.5-ounce lightweight; rip stop nylon cloth with a urethane water barrier coating. The combination of these two materials create a very light weight waterproof cover that is tough, easy to slip into and off of the present art kayak, conforms to the hull shape and adds great esthetic value to the water craft while most importantly preventing water from entering the light weight, folding, kayak or watercraft.

6. Unique Faceted Hull Shape

A key element to the streamlined or fair hull shape of the present invention is the ability to form the extruded corrugated plastic hull and deck material into a non-boxy shape. A streamlined hull that will offer little resistance to movement through the water is attained by breaking a given hull shape into increments. Then creating a blend of compound angles along with the grain or flute direction of the extruded plastic and forming the material into faceted surfaces that create a continuous smooth transition and a fair hull form stem to stern. These compound angles are designed into the hull and deck section flat blanks to achieve the smooth hull transitional shape when folded up into their correct hull or deck shape and held in place with the rib caps.

7. No Metal Components to Rust or Corrode

Unlike prior art folding boats that have used many complicated aluminum and steel components and fasteners that are subject to either rust or corrosion. The present invention has utilized all state-of-the-art plastic materials and fasteners eliminating the need for careful maintenance. The use of theses plastic materials and fasteners also drastically reduces the weight of the folding boat making it more portable with a backpack.

8. The Assembled Kayak

The unique blend of material usage (extruded corrugated plastic) and present art folding boat design concept. Has eliminated the need for the traditional skeletal frame used heretofore in prior art. The benefits of this in the present invention are the huge reduction in the quantities of components. The total number of components has been reduced in this present art to twenty-seven major hull deck rib cap and cover components. The advantage of this improvement over prior art whose number of components often exceeds 200 is obvious as you experience the simplicity of the present inventions assembly. You simply fold each hull section up into its designed shape starting with hull section #1, then fold up #2 hull section and place next to #1 section and slip the rib cap over the integral hull section ribs, insert the nylon thumb screw, then tighten. You then repeat this process six more times. Then you fold the deck sections into their designed shape.

Starting with deck section #1 and inserting the integral deck stiffeners into the rib cap and folding the fastening flaps down to attach to the corresponding hull section. You now have a rigid monocoque kayak assembly ready for the waterproof cover. Open the single split entry in the aft end of the waterproof cover and easily and quickly pull the cover over the hull beginning at the bow end aligning the cover as you slip it on. Then attach the Velcro (a brand name) hook and loop fastener on each half of the opening to close up the aft deck entry section. Adjust the bi-fold flaps cover tightening straps and cockpit drawstring to tighten the cover around the cockpit and the assembly is complete in just a matter of a few minutes. Disassembly of this kayak is much quicker than the assembly. You simply loosen the cockpit drawstring, bi-fold strap; open the aft cover and slip off the waterproof cover quickly and easily. Release the deck fastening flaps and lift off the deck sections. Remove the nylon thumbscrews lift off the rib caps, unfold the hull forward deck sections and the disassembly is complete in minutes. With the disassembly complete, the components are arranged inside of the compact carrying bag for portage or storage for the next adventure.

9. Design Attributes and Safety

In addition to the unique faceted hull shape that allows the creation of a smooth transition hull from flat rigid materials. The present invention is an optimized blend of length, width and hull shape. Using various elements from design perimeters used in the development of kayaks, canoes, dory's, and the inventor's personal experience to generate what is believed to be the optimum blend for the enjoyment and safe operation by novice and experienced water adventures. The hard chine hull shape was chosen because of the many performance and safety factors associated with its design. Hard chine boats resist being pushed off course by waves hitting the hull at an angle. The hard chine boat has good initial stability and resists being tilted. In addition to the initial stability, as the hull is tilted, in rough water conditions, the angled sides and deck offer secondary and tritary flotation, contributing to overall stability. The combination of a wider hull shape allowing the boat to sit higher in the water and the rocker designed into the hull allows the boat to turn and maneuver quickly making it very responsive to the paddler while still possessing the ability to track well in a straight line while touring. Although the hull and decks are technically rigid, the amazing property of the extruded corrugated plastic material is the ability to allow the kayak to absorb shock and impact from collisions with obstacles. Then because of the inherent flexibility, the material returns back to its original shape. Another unique fact about the use of this extruded corrugated plastic material is that it creates a double hull. This instills added safety in that the double hull is filled with air between its walls adding to the positive flotation of the craft in a capsized situation. In addition, the polyethylene material used to manufacture extruded corrugated plastic has positive buoyancy adding to the overall flotation of the boat. Unlike the prior art using a sketial frame with a waterproof skin cover. If you get a sever long tear in the kayaks skin that may not be field repairable you have no alternatives to fall back on but to get a ride from another boat, swim to shore or walk back to civilization. However, with the present invention, if the waterproof cover is damaged beyond field repair capability, all is "Not" lost. Using Duck tape (a brand name) from the repair kit, just wipe the water off of the areas on the outside of the bottom of the hull at each hull section joint. Apply the two-inch wide tape over each section joint and the bow and stern fold areas and you have a waterproof vessel capable of taking you out to safety. Another safety feature is the protection you get from the double wall hull material. In the event you hit a bad snag and cut through the first wall of the hull you have a second wall to maintain the strength and water tightness of the vessel.

10. Ultra Light weight Simple Kayak

The primary goal of the present invention is an ultra light weight water craft embodied in the present art kayak that weighs less than fifteen pounds, making it suitable for extended distance and difficult terrain backpacking. This goal has been achieved through the use of extruded corrugated plastic and all lightweight plastic components and fasteners. The secondary goal is simplicity of manufacture and assembly. This goal has also been achieved in the present art by limiting the number of hull, deck rib cap and cover assembled components to twenty-four plus nylon fasteners.

11. Development of New Boat Designs Using All or Parts of this Invention

The present invention has been disclosed in the form of a kayak, which is a type of covered canoe maneuvered with the use of a double paddle, by a single occupant. However, it should be understood that this invention could readily be modified and adapted to various types of watercraft, and is not limited to the specific features shown. For example, with the addition of four additional center sections, three rib caps, and a longer waterproof cover the single occupant kayak described herein is transformed into a double occupant kayak. Also, by replacing the covered deck sections with narrow deck sections and a modified waterproof cover you create a lighter weight open canoe. These three variations, a single and double kayak and open canoe are all possible from a single hull design using the unique modular concept of the present invention. Through the expansion of this concept it is possible to create rigid hull folding lightweight twin-hulled catamaran type watercraft, dinghies, rowboats, yacht tenders, prams, kick and pontoon boats, and canoes. Such watercraft and many others are possible applications for the present inventions unique material and modular construction systems. The system provides a simple user-friendly environment for the rapid development of new model designs from this unique technology, by allowing the developer to make his layouts right on the hull and deck material. Then cutting out the flat blank shapes, scoring the bend lines and then folding up the shapes all with simple hand tools. These hand made prototypes are ready for water testing as soon as the waterproof prototype cover and rib caps are installed. A major advantage in the use of the elements and methodology of the present invention is that it requires no intermediate tooling or processes as with injection molding or hand laid up fiberglass plugs or molds. This technology has created the capability for the manufacturer to move directly from the manual drawings on paper, or CAD drawings, to the hand layout and cut out method, or using a CAD, DXF, or IGES file to laser cut the sections. This system allows for rapid development of prototype folding boats and other products to be covered in representative alterative embodiments, at very minimal costs with a short time from concept, prototyping, testing and on to the market.

12. Representative Alternate Embodiments

While the basic embodiment of the present invention is a lightweight-folding kayak, which is described in detail, it represents only one embodiment among many other possible ones. All of the alternate embodiments are constructed and assemble in a similar fashion as the present basic embodiment described herein.

1. Canoe (This is the Canoe Made from the Kayak Hull)

Figure 17:
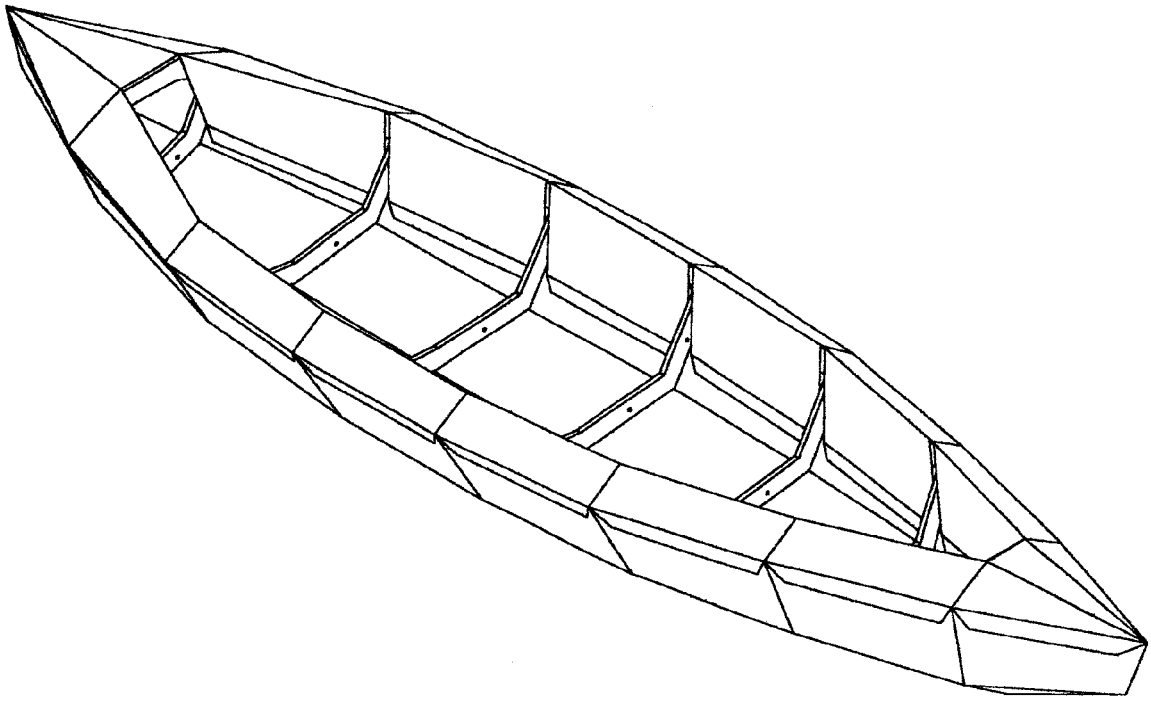
FIG. 17 is a perspective view of the faired kayak hull with modified deck sections converting it into a canoe.

FIG. 17 shows an isometric view of the assembled hull and deck assembly of a canoe. It consists of a plurality of hull and narrow deck sections fastened together with the rib cap system, hook and loop, and nylon fasteners. The waterproof cover is slipped over the assembled hull and deck and fastened with the hook and loop closure at the aft end, and the cover is tightened with the cockpit drawstring and the bi-fold tensioning system. This demonstrates that it is easily within the technology of the present invention to modify the deck of the preferred embodiment creating a canoe.

2. Omni-Canoe

Figure 14:
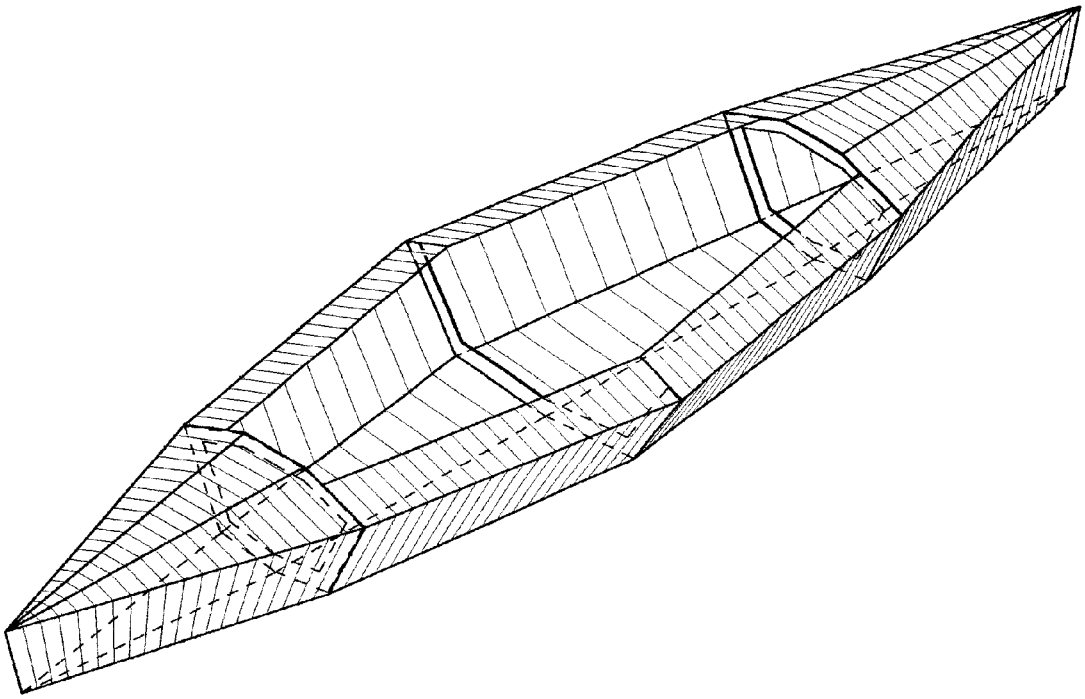
FIG. 14 is a perspective view of the 12-foot basic Omni-Canoe
Figure 15:
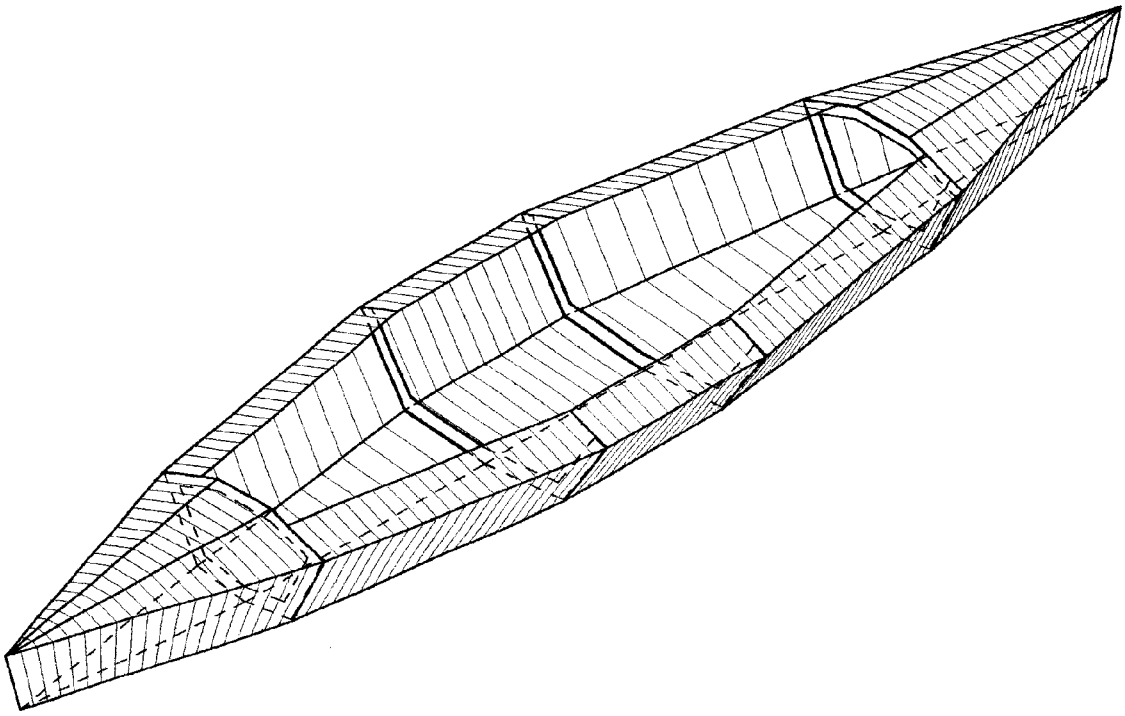
FIG. 15 is a perspective view of a 14-foot Omni-Canoe with one center section added.
Figure 16:
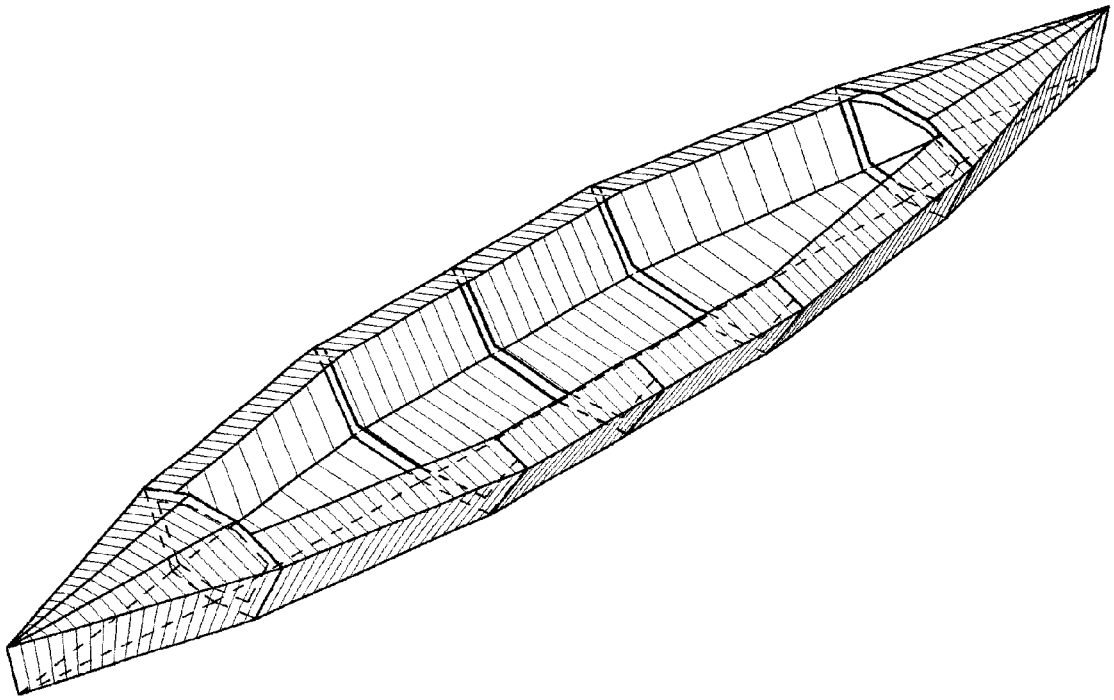
FIG. 16 is a perspective view of a 16-foot Omni-Canoe with two-center section added.

FIGS. 14, 15 and 16 show isometric views of assembled folding Omni-canoes of different lengths they consist of a plurality of hull and narrow deck sections fastened together using the rib cap system, hook and loop, and nylon fasteners. The waterproof cover would be slipped over the assembled hull and deck and fastened with the hook and loop closure at the aft end and the cover is tightened with the cockpit drawstring and bi-fold tensioning system.

The design and construction of this alternate embodiment of the preferred embodiment shifts away from the faired hull concept, and uses simple straight lines with fewer angles with the forward and aft sections being a mirror of each other or absolutely symmetrical. Thereby creating an ultra simple and lightweight boat that can be manufactured with fewer tools because the components for one half are exactly the same for the other half By adding additional common center sections and a longer waterproof cover it is possible to convert one boat into various lengths.

3. Tent and boat Combination

Figure 18:
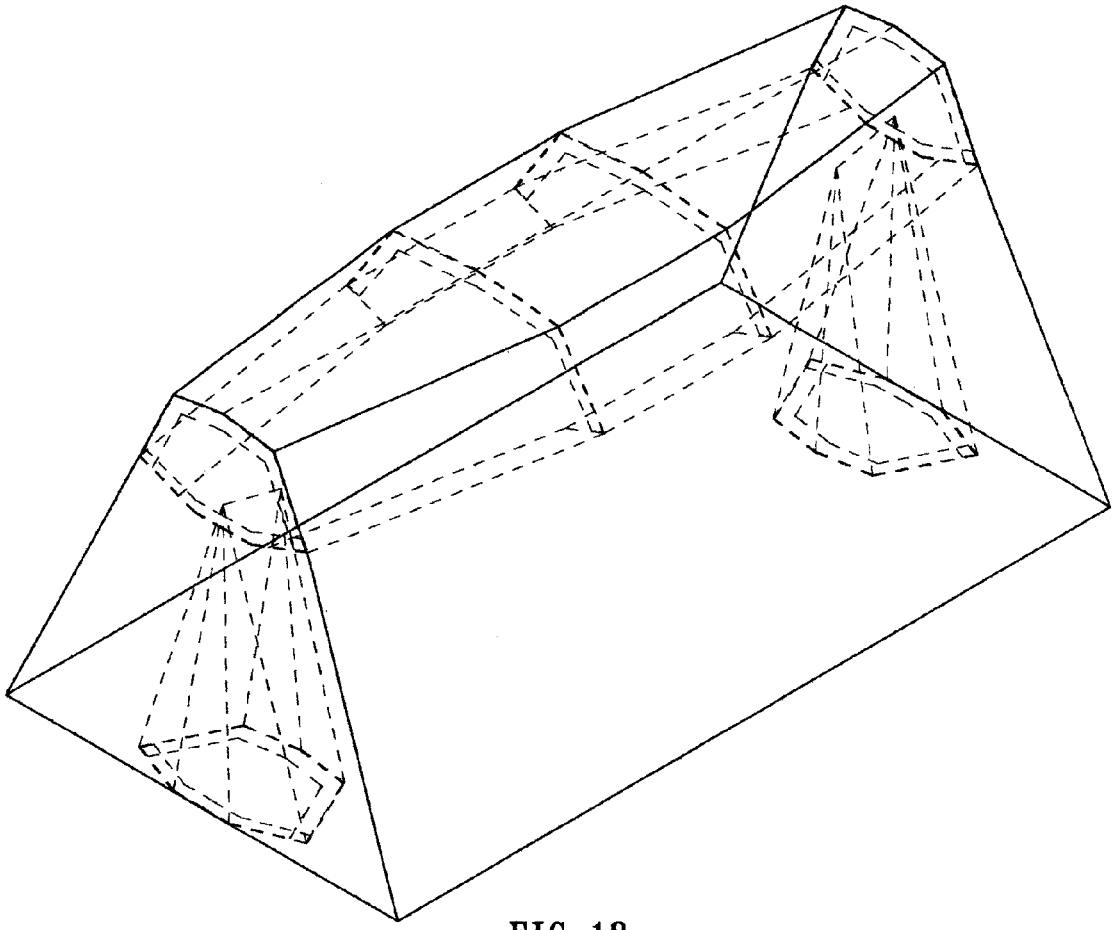
FIG. 18 is a perspective, hidden line view of a pitched tent using the kayak or canoe components with a tent shaped cover.
Figure 19:
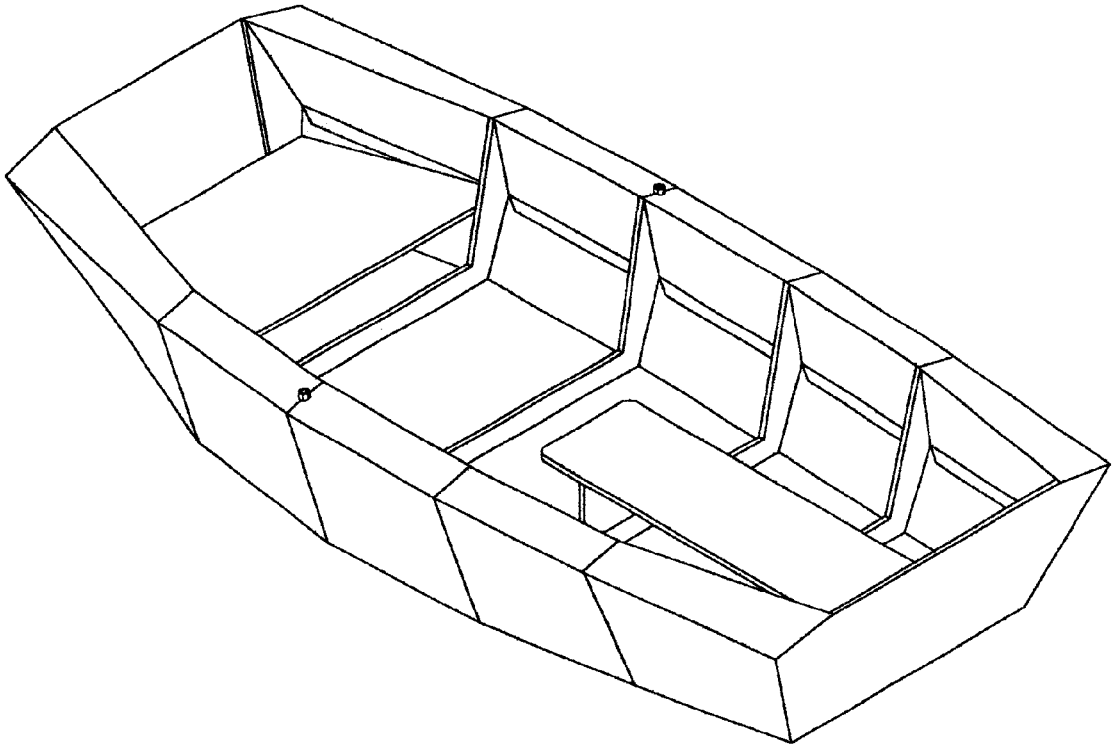
FIG. 19 is a perspective view of the yacht tender, pram or dinghy designed and constructed using the present invention technology, materials and fastening system.

FIG. 18 shows an isometric view of a pitched tent using the components of the present invention reconfigured as a tent frame. There are various parts of the United States and other countries. Where many land trails are interrupted by waterways offering the opportunity to paddle distances with much less effort than carrying your camping equipment in a backpack. However, when the adventurer must carry this equipment, he/she wants it to be as light as possible for the portage. Therefore, having an ultra lightweight watercraft that transforms into a tent frame using a one or two-pound tent cover eliminates the need for making the decision, "Do I backpack my folding watercraft or tent up to the high lakes or across country?" Many tents used today have a total weight greater than this folding boat and tent combination.

4. Dinghy and Pram

FIG.9 shows an isometric view of an assembled folding lightweight dinghy. A dingy is most often seen being towed behind a sailboat, strapped on the foredeck of an ocean going craft or on inland lakes and waterways. Its primary use is to get from the sailboat to the shore and back. Thus a lightweight, easily storable, inexpensive dingy would be desirable to owners of sailing craft and campers wishing to explore and fish quiet, remote lakes and inland waterways. The present invention is intended to provide a folding, lightweight, stable, easy-to-assemble boat that will meet these requirements inexpensively. The design and construction of the dinghy follows exactly the methods used to manufacture the present invention embodiment. The only difference in the design is the squared-off stem and in the case of a pram the bow section is squared-off as well. The same materials, fastening methods and manufacturing methods used for the kayak are used in construction of the dinghy and pram. In addition, the present invention technology is also well suited for the construction of rowboats, yacht tenders and other similar shaped watercraft.

5. Catamaran Type Multihulled watercraft

Twin-hulled catamaran and trimaran type watercraft offer the user advantages not found in single hulled watercraft. Mostly, these multi-hulled watercraft are known for being a very stable platform on which to fish, hunt, skin dive and run rapids. In this case, two hulls are placed parallel to each other, but a distance apart, and interconnected by a platform type of deck. The design and construction of the hulls for this watercraft would be similar to the present art kayak.

However, the open cockpit area would be closed over with a continuation of the fore and aft decks. Making the top deck sections a continuous surface to support the interconnection platform deck and seat with provision for oar locks and foot rests. In accordance with the present invention the platform deck would be constructed for easy disassembly and folding so as to be packaged similarly to the hulls for easy portage and backpacking. The overall design for the hulls of this watercraft would be a modification of the present embodiment maintaining the strict principles of lightweight, strength, simplicity of assembly and construction and low cost manufacturing.

6. Materials and Construction of a Monocoque Hull and Deck

By this point the reader can see that through the use of the unique elements of the present invention and methodology that a wide variety of watercraft can be designed, developed, and built rather quickly and inexpensively. Through various combinations and with the various embodiments of its extruded corrugated plastic, living hinge, hull and deck sections, rib cap assembly method, and waterproof cover with its bi-fold skin tensioning system. That a wide variety of lightweight folding watercraft can be designed and built. Some may employ a different subset of the elements as seen in the alternate embodiments.

It can be appreciated from the above that this technology can be adapted to building lightweight, folding, car top carriers, waterproof boat boxes, fold down coolers, collapsible ice shanties, utility sheds, dog houses, bird houses, play houses for kids and rigid "folding camping tents".

What is claimed is:

1. A collapsible, rigid hull, sectional boat assembly, comprising:

a) a plurality of separate, individual, rigid, foldable hull section members each forming a transverse segment of the bottom hull and opposite hull side walls of an assembled elongated boat hull, each said hull section member comprising:

1). a substantially rigid sheet formed of a selected synthetic thermoplastic resin material having predetermined, first hinge fold lines defining and foldably dividing the sheet into at least one bottom hull panel and a pair of opposite hull side wall panels foldable relative to each other along mutual said first hinge fold lines between an operative position forming a transverse segment of a boat hull configuration and a collapsed, folded, storage condition in which said hinged panels are disposed in substantially stacked condition, and 2). a pair of opposite rib flaps on each said hull panel formed by opposite, second hinge fold lines positioned on the sheet a spaced distance inwardly of and extending along the opposite, commonly-shared terminal edges of each said hull panel, said second hinge fold lines arranged to permit each said opposite rib flap to be folded into an operative condition extending substantially perpendicularly relative to the plane of the surface of its corresponding hull panel, b) a plurality of substantially rigid rib cap members configured to supportingly engage corresponding rib flaps of adjacent hull panels of adjacent hull sections and releasably secure said plurality of hull sections together in predetermined elongated hull configuration, c) securing means for releasably interengaging and securing said rigid rib cap members and said adjacent corresponding rib flaps together to secure said plurality of hull sections together into a complete, rigid, elongated boat hull, d) a plurality of rigid, foldable top deck section members each comprising a rigid sheet formed of a selected synthetic thermoplastic resin material having first hinge fold lines forming panels configured to allow the deck section to fold in order to overlie at least the top edge of a selected hull side wall panel and be releasably secured to at least one face surface of the selected hull side wall panel, each said top deck section having second hinge fold lines forming at least one pair of opposite deck attachment flaps configured to engage a pair of rib cap members for releasable securement of the top deck section member therebetween, e) securing means for releasably interengaging and securing said rigid rib cap members and corresponding deck attachment flaps together to releasably secure said plurality of top deck section members between said plurality of rib cap members, and f) means for preventing the passage of water between adjacent hull section members into the interior of the boat when the boat is on a body of water, whereby g) the plurality of said hull and deck section members and rib cap members may be quickly and easily assembled into a complete rigid hull boat for use on a body of water and also quickly and easily disassembled, each hull and deck section individually folded into collapsed, stacked condition for extremely compact storage and convenient transport in a carrying bag or backpack.

2. The collapsible rigid hull boat assembly of claim 1 wherein said hull section members are formed of sheets of corrugated plastic.

3. The collapsible rigid hull boat assembly of claim 1, wherein said top deck section members are formed of sheets of corrugated plastic.

4. The collapsible rigid hull boat assembly of claim 1 wherein said means for preventing passage of water comprises a gasket seal interposed sealingly between adjacent hull section members forming the assembled, elongated rigid boat hull.

5. The collapsible rigid hull boat assembly of claim 1 wherein said means for preventing passage of water comprises a flexible, water-impervious, fitted fabric boat cover configured to be secured to the boat in condition fully enveloping and covering at least the entire exterior hull surface of the boat.

6. The collapsible rigid hull boat assembly of claim 5 wherein said fitted fabric boat cover is further configured to also envelop and cover the exterior top deck surface of the boat.

* * * * *